US006318120B1

(12) United States Patent
Ha

(10) Patent No.: US 6,318,120 B1
(45) Date of Patent: Nov. 20, 2001

(54) CRYOGENIC DISTILLATION SYSTEM FOR AIR SEPARATION

(75) Inventor: Bao Ha, San Ramon, CA (US)

(73) Assignee: L'Air Liquide Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/637,793

(22) Filed: Aug. 11, 2000

(51) Int. Cl.[7] ..... F25J 3/00
(52) U.S. Cl. ..... 62/646; 62/924
(58) Field of Search ..... 62/643, 646, 924, 62/648

(56) References Cited

U.S. PATENT DOCUMENTS 4,670,031 * 6/1987 Erickson ..... 62/646
5,034,043 * 7/1991 Rottmann ..... 62/924
5,799,508 * 9/1998 Bonaquist et al. ..... 62/646
5,868,199 * 2/1999 Lavin ..... 165/166
6,202,441 * 3/2001 Ha ..... 62/646

* cited by examiner

*Primary Examiner*—William Doerrler
(74) *Attorney, Agent, or Firm*—Young & Thompson

(57) ABSTRACT

In a process for production of oxygen enriched fluid and argon enriched fluid by cryogenic distillation of air, a feed stream (1) containing nitrogen, oxygen and argon is sent to a main column system wherein it is separated by cryogenic distillation, an argon containing gaseous stream (33) is removed from a column (103) of the main column system, said column operating at a pressure of at least 2 bar abs., and the argon containing gaseous stream is at least partially condensed, at least part of the at least partially condensed argon containing gaseous stream is sent to an intermediate point of an argon column (104) and an argon enriched product stream (80) is removed from the top of the argon column and a first oxygen enriched product stream (36) is removed from the bottom of the argon columnn.

13 Claims, 3 Drawing Sheets

CRYOGENIC DISTILLATION SYSTEM FOR AIR SEPARATION

BACKGROUND OF THE INVENTION

Figure 1:
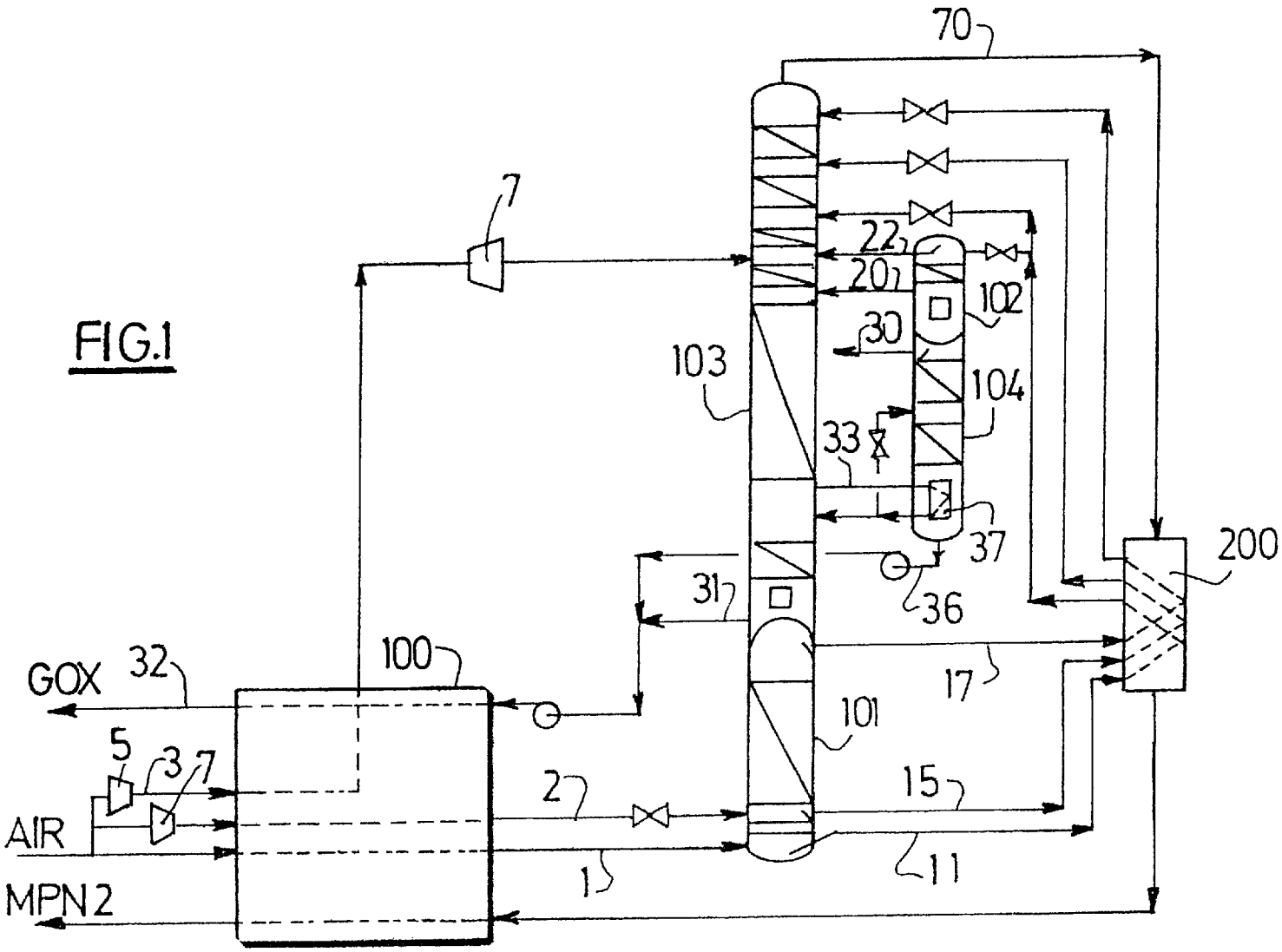

This invention applies in particular to the production of oxygen, nitrogen and argon by cryogenic distillation. Over the years numerous efforts have been devoted to the improvement of this production technique to lower the oxygen cost which consists mainly of the power consumption and the equipment cost.

It has been known that an elevated pressure distillation system is advantageous for cost reduction and when the pressurized nitrogen can be utilized, the power consumption of the system is also very competitive. It is useful to note that an elevated pressure system is characterized by the fact that the pressure of the lower pressure column being above 2 bar absolute. The conventional or low pressure process by contrast has its lower pressure column operating at slightly above atmospheric pressure.

The higher the pressure of the lower pressure column, the higher is the air pressure feeding the high pressure column and the equipment for both warm and cold portions of the plant is more compact resulting in significant cost reduction. However, the higher the pressure, the more difficult is the distillation process since the volatilities of the components present in the air (oxygen, argon, nitrogen etc) become closer to each other such that it would be more power intensive to perform the separation by distillation. Therefore the elevated pressure process is well suited for the production of low purity oxygen (<98 mol. % purity) wherein the separation is performed between the easier oxygen-nitrogen key components instead of the much more difficult oxygen-argon key components. The volatilities of oxygen and argon are so close such that even at atmospheric pressure it would require high number of distillation stages and high reboil and reflux rates to conduct such separation. The elevated pressure process in the current configuration of today's state-of-the-art process cycles is not suitable or economical for high purity oxygen production (>98 mol. % purity). Since the main impurity in oxygen is argon, the low purity oxygen production implies no argon production since over 50% of argon contained in the feed air is lost in oxygen and nitrogen products.

One object of the invention is to provide an elevated pressure process capable of high purity oxygen production and also argon production.

The new process described below applies the basic double-column process with sidearm argon column with some modifications to improve the distillation under elevated pressure to yield higher purity oxygen along with the argon by-product.

One example of the elevated pressure double-column process is described in U.S. Pat. No. 5,224,045.

U.S. Pat. No. 4,737,177 describes double column system with a sidearm argon column wherein a short column is added above the overhead condenser of this column to improve further the distillation process for oxygen and argon production.

U.S. Pat. No. 5,572,874 describes a low pressure distillation process with argon wherein the low pressure rectification column of a double column system operates at 2 bar pressure or lower. In this process, an argon-enriched vapor stream is withdrawn from the low pressure rectification column and is at least partially condensed in a reboiler-condenser which reboils oxygen separated in the argon column. One part of the resulting at least partially condensed argon-enriched stream is expanded through a valve to a lower pressure and is introduced into the argon column in which it is separated into argon and oxygen. Even with additional trays at the bottom of the argon column to distil oxygen product and with lower operating pressure, this process still yield an acceptable temperature approach of the overhead condenser thanks to the low pressure drop of the structured packing being utilized in the argon column.

U.S. Pat. No. 5,305,611 describes a low pressure distillation process with argon wherein the low pressure rectification column of a double column system operates at between 14.7 and 75 psia. In this process, an argon-enriched vapor stream is withdrawn from the low pressure rectification column and is condensed in a reboiler-condenser which reboils the argon column. The resulting condensed argon-enriched stream is expanded through a valve to a lower pressure and is introduced into the argon column in which it is separated to form the argon rich product. The bottom liquid of the low pressure column is sent back to the low pressure column. In this system all the product oxygen is recovered at the bottom of the low pressure column.

U.S. Pat. No. 5,245,832 discloses a process wherein a double-column system at elevated pressure is used in conjunction with a third column to produce oxygen, nitrogen and argon. In order to perform the distillation at elevated pressure a nitrogen heat pump cycle is used to provide the needed reboil and reflux for the system. In addition to the power required for the separation of argon and oxygen in the third column the heat pump cycle must also provide sufficient reflux and reboil for the second column as well such that the resulting recycle flow and power consumption would be high.

The new invention improves the distillation at elevated pressure by adding a crude argon column to the elevated pressure double-column column process to perform an efficient separation of argon and oxygen. In one embodiment (FIG. 1) compressed air free of impurities such as moisture and CO2 is fed to a high pressure column where it is separated into a nitrogen rich stream at the top and an oxygen rich stream at the bottom. At least a portion of the oxygen rich stream is fed to a short column to yield a second nitrogen rich stream at the top and a second oxygen rich stream at the bottom. This short column has a reboiler which exchanges heat with the argon enriched gas at or near the top of the argon column.

At least a portion of the second nitrogen rich stream and/or at least a portion of the second oxygen rich stream is/are fed to the low pressure column.

At least a portion of the second oxygen rich stream is vaporized in the overhead condenser of the argon column and this vaporized stream and/or the non-vaporized portion is/are fed to the low pressure column.

The low pressure column separates its feeds into a third oxygen rich stream at the bottom and a third nitrogen rich stream at the top. At least a portion of the third oxygen rich stream is recovered as oxygen product in gaseous and/or liquid form.

An oxygen and argon containing gaseous stream is removed at an intermediate tray of the low pressure column. This oxygen-argon containing stream is at least partially condensed at the bottom reboiler of the argon column. A portion of this partially condensed oxygen-argon containing stream is fed to the argon column. An argon enriched stream is recovered at the top of the argon column and a fourth oxygen rich stream at the bottom of the crude argon column.

At least a portion of the fourth oxygen rich stream is recovered as oxygen product.

According to an object of the invention, there is provided a process for production of oxygen enriched fluid and argon enriched fluid by cryogenic distillation of air comprising the steps of:

a) sending a feed stream containing nitrogen, oxygen and argon to a main column system wherein it is separated by cryogenic distillation;

b) removing an argon containing gaseous stream from a column of the main column system, said column operating at a pressure of at least 2 bar abs., and at least partially condensing the argon containing gaseous stream;

c) sending at least part of the at least partially condensed argon containing gaseous stream to an intermediate point of an argon column; and d) removing an argon enriched product stream from the top of the argon column and a first oxygen enriched product stream from the bottom of the argon column. According to optional features of the process, the argon containing gaseous stream condenses by indirect heat exchange with liquid at the bottom of the argon column.

part of the at least partially condensed argon containing gaseous stream is sent to the main column system.

the main column system comprises a high pressure column and a low pressure column, the argon containing gaseous stream being removed from the low pressure column.

a stream containing nitrogen, oxygen and argon is expanded in a turbine and sending the expanded stream to the low pressure column.

oxygen enriched liquid is sent from the high pressure column to a top condenser of the argon column.

the oxygen content of the oxygen enriched liquid is enriched following removal from the high pressure column and before sending it to the argon column top condenser.

a second oxygen enriched product stream is removed from the low pressure column.

the first and second oxygen enriched product stream are mixed to form a mixed stream and the mixed stream is vaporized in a heat exchanger.

the first and second oxygen enriched streams are mixed in the argon column and pumping the oxygen enriched stream removed from the argon column to a desired pressure.

nitrogen enriched gas is removed from the high pressure and/or low pressure column.

the argon containing gaseous stream contains between 3 and 20 mol. % argon.

the argon containing gaseous stream is withdrawn at point between 2 and 12 theoretical trays above the bottom of the low pressure column.

The low pressure column in this process is defined as a column which operates at a pressure at its top of at least 2 bar abs. or higher.

Figure 2:
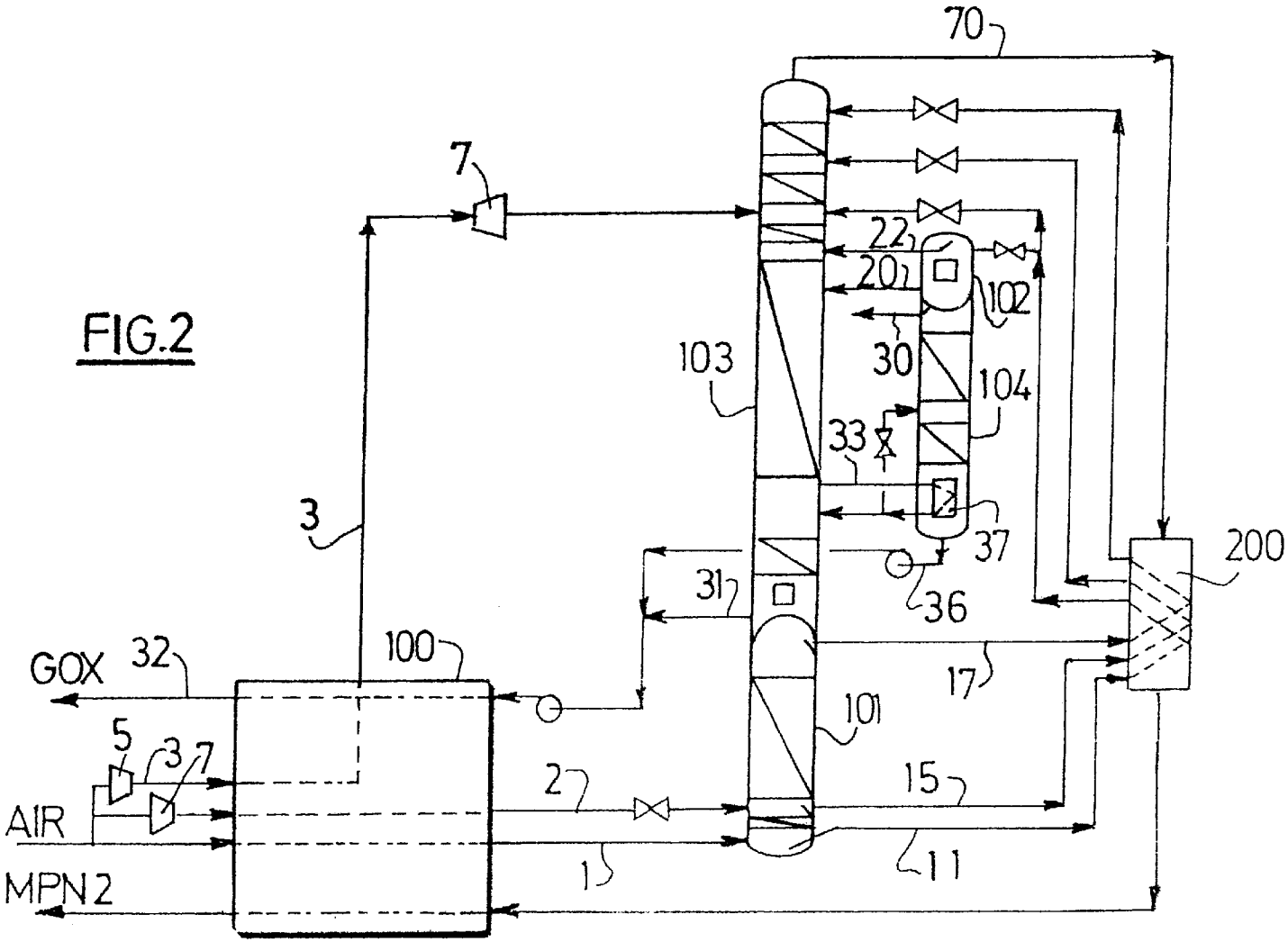
Figure 3:
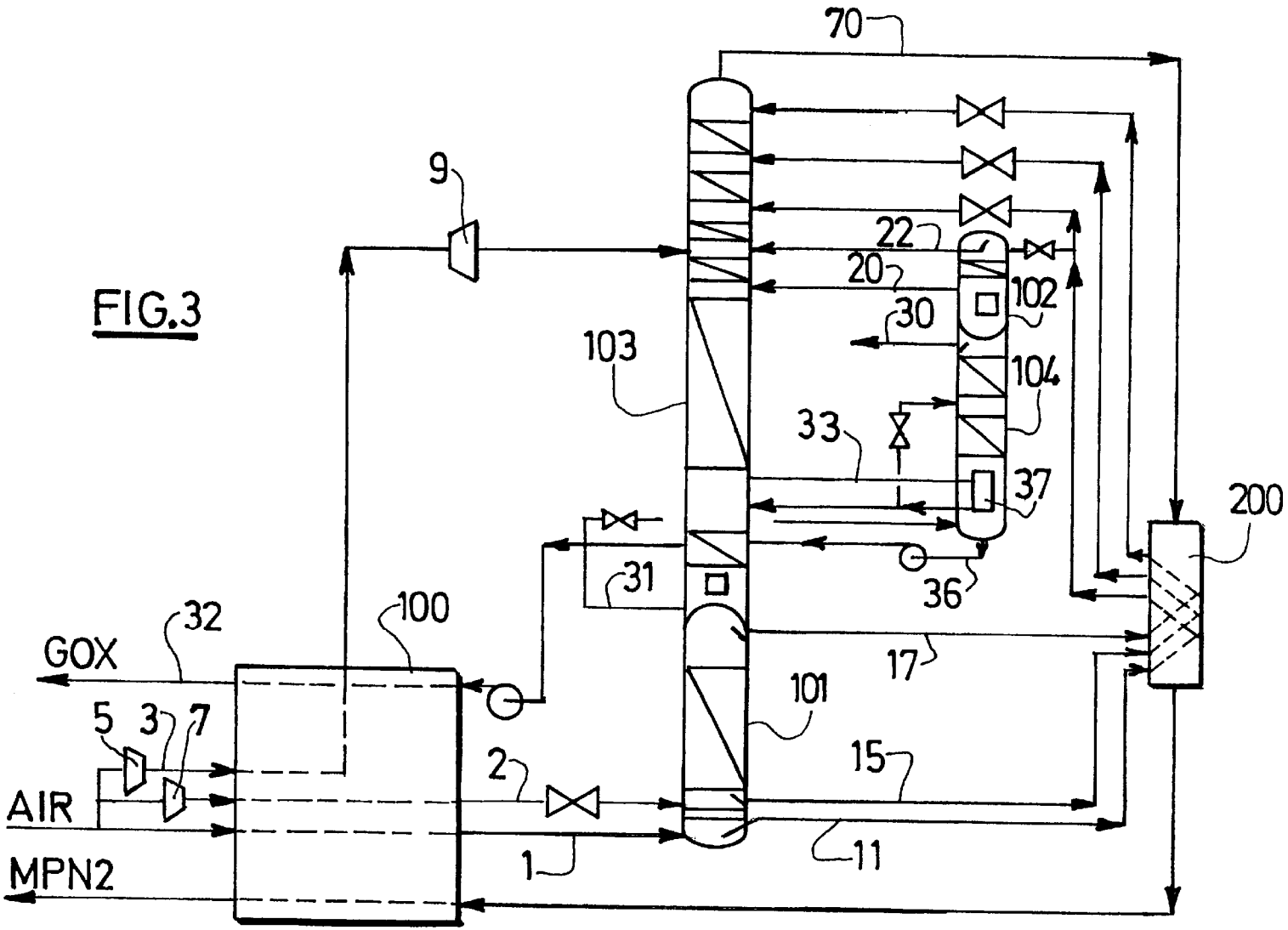

FIGS. 1–3 show schematically installations which may be operated using the process according to the invention.

DETAILED DESCRIPTION OF THE INVENTION

In the embodiment of FIG. 1, compressed air free of moisture and CO2 is cooled in the main exchanger 100 and divided into three streams 1,2,3, one of which 1 is fed directly to the high pressure column 101 in gaseous form. The second stream 2 is pressurized in booster 7, sent to exchanger 100 where it is cooled, expanded in a valve and sent to the high pressure column 101 at least partially in liquid form at least one theoretical tray above the point of introduction of stream 1. The third stream 3 is also compressed in a booster 5, cooled to an intermediate temperature of the exchanger 100 and expanded to the pressure of the low pressure column 103 in a turbine 9. First oxygen rich stream 11 extracted from the bottom of column 101 is expanded in a valve and sent to short column 102 wherein it is separated into a second oxygen rich stream 20 and a second nitrogen rich gaseous stream 22 at the top. Both streams 20 and 22 are sent to the low pressure column 103.

A liquid air stream 15 is removed from the high pressure column, subcooled in exchanger 200 and sent to the low pressure column following an expansion step.

A liquid nitrogen rich stream 17 is removed from the top of the high pressure column, subbooled in exchanger 200 and sent to the low pressure column following an expansion step.

The low pressure column 103 operating at 3 bar abs. separates its feeds into a third oxygen rich liquid stream 31 at the bottom and a third nitrogen rich gaseous stream 70 at the top. Stream 31 is recovered as oxygen product either in liquid form or in gaseous form, following pumping and vaporization in exchanger 100. The short column 102 operates at a pressure about the same as the low pressure column's pressure and is reboiled by the top gas of the argon column 104.

A gaseous stream 33 containing between 3 and 20 mol. % argon is extracted at an intermediate tray (e.g. at least 3 theoretical trays above the bottom of the low pressure column) of the low pressure column 103. Stream 33 is at least partially condensed in reboiler 37, part of the stream is sent back to the low pressure column and the remainder of stream 33 comprising principally oxygen and argon is fed to an intermediate point of the argon column 104 wherein it is separated into an argon rich liquid stream 30 at the top and a fourth oxygen rich stream 36 at the bottom.

Alternatively or additionally gaseous argon rich and/or oxygen rich streams could be produced. Stream 36 is recovered as oxygen product and may be pumped to the low pressure column pressure, mixed with stream 31 and sent to exchanger 100.

The argon column operates at a pressure lower than the low pressure column's pressure, e.g at least one bar less than the low pressure column, in this case 2 bar abs.

Under elevated pressure the distillation in the high pressure column becomes less efficient and less nitrogen reflux or product can be extracted at the top of this column. This results in the oxygen rich stream at the bottom of this column being richer in nitrogen. This liquid when vaporized in the top condenser of the argon column as in conventional or classical process would result in large temperature approach which is a source of thermodynamic inefficiency. Therefore by adding a short column and extracting a nitrogen rich stream at the top of this short column we can reduce the temperature approach and provide better feed matching in the low pressure column.

The net result is more efficient distillation allowing possible pure oxygen production and argon production under elevated pressure.

In FIG. 1 the oxygen product is recovered as liquids from the columns. The liquid is pumped to high pressure and vaporized in the heat exchanger 100 against condensing high pressure air (stream 2) to yield high pressure gaseous oxygen (stream 32). This is called the LOX pumped cycle.

In the embodiment of FIG. 2 there is shown a similar arrangement to that of FIG. 1 but the short column above the argon column is eliminated. This situation applies when the fed air pressure is not too high resulting in more efficient distillation in the high pressure column and consequently higher oxygen concentration in the first oxygen rich stream such that it is no longer necessary to perform additional distillation in such short column.

There are some similarities between the FIG. 2 and U.S. Pat. No. 5,572,874 but the range of application is not the same. U.S. Pat. No. 5,572,874 was developed for low pressure applications where the low pressure rectification is at 2 bar abs or lower. In this new process the low pressure rectification is higher than 2 bar abs.

U.S. Pat. No. 5,572,874 takes advantage of the low pressure drop of the structured packing to add trays to the argon column and lower its operating pressure so that good oxygen recovery can be maintained even if the reboil at the bottom of the low pressure column is reduced. This situation occurs when some N2 vapor product is extracted from the top of the high pressure column resulting in reduction of the said reboil. This possibility also occurs when a portion of the N2 vapor from the top of the high pressure column is diverted to reboil an intermediate column as described in U.S. Pat. No. 5,231,837 is used to provide additional nitrogen rich reflux to the low pressure column.

In this new process the usage of the argon column and bottom reboiler serves a totally different purpose and this possibility was not anticipated at all in U.S. Pat. No. 5,572,874 indeed, the production of high purity oxygen implies the difficult separation argon-oxygen. When the pressure of the low pressure column increases the separation oxygen-argon becomes more and more difficult. This can be illustrated by the K-value of Argon in Oxygen liquid at several pressures:

| Pressure, bar abs | 1 | 2 | 3 | 4 |
|---|---|---|---|---|
| K-value Ar in O2 | 1.57 | 1.48 | 1.43 | 1.39 |

The smaller the K-value of argon in oxygen the harder it takes to distil argon out of oxygen to produce pure oxygen. When the low pressure column's pressure exceeds 2 bar abs, the reduction in K-value is such that in a double-column with LOX pumped cycle, even without any extraction of N2 at the top of the high pressure column, it becomes uneconomical to produce pure oxygen. Indeed, the resulting oxygen recovery is low and many distillation trays will be needed. By condensing the oxygen-argon stream, extracted not at the bottom but at an intermediate tray of the low pressure column, in a bottom reboiler of the argon column, we can:

maximize the reboil at the bottom of the low pressure column produce an additional pure oxygen stream such that less oxygen production is required at the bottom of the low pressure column. This allows matching the reduction of K-value under elevated pressure and a lesser amount of oxygen produced at the bottom of the low pressure column. Therefore by producing some pure oxygen at the bottom of the argon column and less oxygen at the bottom of the low pressure column we can maintain good overall oxygen recovery.

To save the cost of a pump, the oxygen rich liquid 31 from the low pressure column may be expanded in a valve, in either of the embodiments of FIGS. 1 and 2, and then sent to the bottom of the argon column 104. See FIG. 3. The oxygen rich liquid stream 36 removed from the argon column will therefore contain liquid transferred from the low pressure column and only one pump is required.

What is claimed is:

1. A process for production of oxygen enriched fluid and argon enriched fluid by cryogenic distillation of air comprising the steps of:

a) sending a feed stream containing nitrogen, oxygen and argon to a main column system wherein it in separated by cryogenic distillaton;

b) removing an argon containing gaseous stream from a column of the main column system, said column operating at a pressure of at least 2 bar abs., and at least partially condensing the argon containing gaseous stream;

c) sending at least part of the at least partially condensed argon containing gaseous stream to an intermediate point of an argon column; and d) removing an argon enriched product stream from the top of the argon column and a first oxygen enriched product stream from the bottom of the argon column.

2. The process of claim 1 wherein the argon containing gaseous stream condenses by indirect heat exchange with liquid at the bottom of the argon column.

3. The process of claim 1 comprising sending part of the at least partially condensed argon containing gaseous stream to the main column system.

4. The process of claim 1 wherein the main column system comprises a high pressure column and a low pressure column, the argon containing gaseous stream being removed from the low pressure column.

5. The process of claim 4 comprising expanding a stream containing nitrogen, oxygen and argon in a turbine and sending the expanded stream to the low pressure column.

6. The process of claim 4 comprising sending oxygen enriched liquid from the high pressure column to a top condenser of the argon column.

7. The process of claim 6 comprising enriching the oxygen content of the oxygen enriched liquid following removal from the high pressure column and before sending it to the argon column top condenser.

8. The process of claim 4 comprising removing a second oxygen enriched product stream from the low pressure column.

9. The process of claim 8 comprising mixing the first and second oxygen enriched product streams to form a mixed stream and vaporizing the mixed stream in a heat exchanger.

10. The process of claim 9 comprising mixing the first and second oxygen enriched streams in the argon column and pumping the oxygen enriched stream removed from the argon column to a desired pressure.

11. The process of claim 4 comprising removing nitrogen enriched gas from the high pressure and/or low pressure column.

12. The process of claim 1 wherein the argon containing gaseous stream contains between 3 and 20 mol. % argon.

13. The process of claim 12 wherein the argon containing gaseous stream is withdrawn at point between 2 and 12 theoretical trays above the bottom of the low pressure column.

* * * * *